United States Patent [19]

Trunley et al.

[11] 4,140,530

[45] Feb. 20, 1979

[54] PREPARATION OF PHOTOGRAPHIC MATERIAL

[75] Inventors: Roy Trunley, Rayleigh; Howard R. Hopwood, Chelmsford, both of England

[73] Assignee: Ciba-Geigy AG, Basel, Switzerland

[21] Appl. No.: 876,449

[22] Filed: Feb. 9, 1978

[30] Foreign Application Priority Data

Feb. 18, 1977 [GB] United Kingdom ..... 6857/77

[51] Int. Cl.[2] ..... G03C 1/76; G03C 1/40; G03C 1/02

[52] U.S. Cl. ..... 96/67; 96/82; 96/84 R; 96/100 R; 96/109; 96/111; 96/113; 96/114; 96/114.5; 96/120; 96/130

[58] Field of Search ..... 96/97, 100, 120, 130, 96/109, 84 R, 67, 111, 82

[56] References Cited

U.S. PATENT DOCUMENTS

| | | | |
|---|---|---|---|
| 2,852,381 | 9/1958 | Minsk et al. | 96/97 |
| 3,287,134 | 11/1966 | Kainrath et al. | 96/100 |
| 3,660,101 | 5/1972 | Owens et al. | 96/130 |
| 3,676,147 | 7/1972 | Boyer et al. | 96/130 |
| 4,006,025 | 2/1977 | Swank et al. | 96/130 |

*Primary Examiner*—J. Travis Brown

*Attorney, Agent, or Firm*—Sprung, Felfe, Horn, Lynch & Kramer

[57] ABSTRACT

Photographic additives in particular water insoluble photographic additives are rendered easier to incorporate into photographic layers by finely dividing them, mixing them with a finely divided water soluble substance and preparing granules of the mixture using a hydrophilic colloid as the binder. The granules which contain from about 1 to 50% by weight of the photographic additives are then dissolved in the coating composition and this disperses the water insoluble additive uniformly throughout the coating composition.

18 Claims, No Drawings

PREPARATION OF PHOTOGRAPHIC MATERIAL

This invention relates to a process for the production of photographic silver halide material.

Usually it is required to incorporate various additives into photographic layers and in particular silver halide emulsion layers and these additives are very often water insoluble. The conventional method of incorporating water insoluble additives for example optical sensitising dyes into photographic layers consists of dissolving the additive in an appropriate organic solvent for example methyl alcohol, ethyl alcohol or acetone, and adding the resulting solution to an aqueous photographic coating composition. Whilst this method has provided a commercially feasible means for incorporating optical sensitising dyes and other water insoluble photographic additives into photographic layers, and in particular silver halide emulsions, it still requires considerable care and extra manipulative steps in adjusting the volume of solvent to quantities compatible with the particular emulsion to produce the desired results. Also it is well known that excessive solvent engenders disadvantageous diffusion or wandering of the additives in the layers. If this excessive solvent is removed before coating this requires a costly and hazardous process.

The present invention provides a method of incorporating photographic additives and in particular water-insoluble additives into photographic layers of photographic material.

In a method for preparing photographic material which comprises at least one silver halide emulsion layer coated on the photobase there are provided the steps of adding to an aqueous photographic colloid coating composition a solid photographic additive composition in granular form which comprises a homogeneous mixture of at least one finely-divided photographic additive which constitutes from 1 to 50% by weight of the granule, at least one finely-divided water-soluble solid which acts as a dispersing agent for the additive and which constitutes from 1 to 80% by weight of the granule and a solid photographically inert hydrophilic colloid which acts as a binder for the granule and which constitutes from 1 to 50% by weight of the granule, allowing the granular composition to dissolve and coating the aqueous photographic colloid coating composition as a layer on a photobase and drying.

It is required that the water-soluble solid should have no adverse photographic effect.

Preferably the solid should yield a colourless solution. The solid must be water-soluble, that is to say, soluble to the extent of at least 3g/liter water and preferably at least 20g/liter.

Suitable photographically inert hydrophilic colloids for use as the binder in the granules used in the process of the present invention include gelatin, sodium cellulose sulphate, carboxy methyl cellulose, albumen, casein, polyvinyl alcohol and polyvinyl pyrrolidone. The particularly preferred colloid is gelatin.

By 'finely divided' is meant that the average particle size of the solid is at most 400 microns.

The finely divided water-soluble solid which acts as a dispersing agent for the additive may be a water soluble wetting agent or it may be merely an inert water-soluble organic or inorganic solid. A list of suitable solids is given hereafter. Preferably there is present in the granule both a solid wetting agent and an inert water-soluble organic or inorganic solid which serves to give a certain body to the granule which helps when the granule is handled. If all the solid which acts as a dispersing agent for the additive is present as wetting agent this could affect the coating preparation of the colloid coating composition.

The use of a wetting agent in the granules is especially preferred when the photographic additive is water-insoluble. In fact the method of the present invention is of particular use when the photographic additive is water-insoluble but it can be used when the photographic additive is water-soluble.

If more than 50% by weight of the granule consists of the hydrophilic binder then the granule takes too long to break-down and dissolve in the colloid coating composition to be of use in the preparation of photographic material. Preferably the proportion of hydrophilic colloid present in the granule comprises only from 1 to 10% by weight of the granule.

Thus preferably in the method of the present invention the granules used comprise from 35 to 85% by weight of the water-soluble solid, from 1 to 15% by weight of the solid wetting agent, from 5 to 50% by weight of the photographic additive or additives and from 1 to 10% by weight of the hydrophilic colloid.

The granules of use in the present invention are prepared by mixing the ingredients together with a little water to form a paste and then drying the paste so as to form granules.

Therefore there is provided a process for the preparation of photographic material which comprises the steps of forming photographic additive granules by making a homogeneous mixture of a finely divided water-soluble photographically inert solid, at least one finely divided water-insoluble photographic additive, a finely divided solid wetting agent, a finely divided hydrophilic colloid and water, forming a paste of the mixture, noodling the paste and drying the noodles to form granules, each granule being substantially of the same constitution and containing from 5 to 50% by weight of the photographic additive or additives, from 35 to 85% by weight of the water-soluble solid, from 1 to 15% by weight of the solid wetting agent and from 1 to 10% by weight of the hydrophilic colloid, then addding the requisite weight of the granules to an aqueous photographic colloid coating composition allowing the granules to dissolve and coating the aqueous coating composition as a layer on photographic base and drying. Preferably the paste is noodled by passing it through a sieve to form short noodles which break up further when dried to form granules.

Surprisingly it has been found that when the granules containing the photographic additive or additives are added to the photographic coating composition that the granule breaks down and dissolves at a controlled rate causing the photographic additive to be dispersed in the coating composition in such a way that it does not precipitate nor coagulate in the coating composition. But when water-insoluble photographic additives in finely divided form are added alone or in mere admixture with a water-soluble solid to a photographic coating composition then they tend to precipitate or coagulate and are not dispersed in the coating composition evenly so that the dried layer does not contain the additive is a useful form. However then the additive is added with the water-soluble solid in granule form the fact of breakdown and dissolution of the granule which is controlled by the hydrophilic colloid present which acts as a binder for the granule seems to cause the additive to disperse in the aqueous coating composition in a correct manner so that when the dried layer is formed the additive is present in the layer in a photographically useful form. The presence of a wetting agent in the granule helps this dispersion of the additive when the granule breaks down and dissolves.

The process of the present invention is of particular use when the photographic colloid coating composition is an aqueous gelatino silver halide emulsion coating composition. When the photographic colloid coating composition is a silver halide emulsion, examples of water insoluble additives which are often required to be added thereto are optical sensitizers, stabilizers, antifoggants, colour couplers and actuance dyes. All of these are usually water-insoluble. Further additives are hardeners, optical brightening agents and coating acids.

The invention is especially useful when the additive is an optical sensitizing dye. Most optical sensitizing dyes are highly water-insoluble, although a few can be said to be sparingly water soluble. Optical sensitizing dyes are usually added to aqueous silver halide emulsions, for adsorption on to silver halide crystals, by dissolving them in ethanol or other simple alcohols, adding the alcoholic solution to the emulsion and the either leaving the alcohol in the aqueous silver halide emulsion or removing the alcohol, which is difficult. However if there is already present in the silver halide emulsion colour couplers dissolved in oil dispersions often the alcohol leaches out the colour couplers from the dispersion causing the colour couplers to crystalize. Also the need to produce very concentrated silver halide emulsion for coating by high speed processes such as cascade coating means that the emulsion should not be diluted by the addition of sensitising dyes dissolved in solvents such as alcohol. However by means of the process of the present invention it is possible to add optical sensitising dyes in a highly concentrated form to aqueous silver halide emulsions. When the optical sensitising dye is added to the silver halide emulsion in the granules the solid dissolves in the aqueous emulsion and the dye is dispersed throughout the emulsion in such a form that it can become adsorbed by the silver halide crystals.

Alternatively in the process of the present invention the photographic colloid coating composition forms a layer which is a non-light-sensitive colloid layer, preferably a gelatin layer, which may be an inter-layer between emulsion layers, a super-coat layer, an underlayer or a backing layer. If the colloid layer is a supercoat layer the additive may be for example an optical brightening agent or a U.V. Absorber. If the colloid layer is an inter-layer the additive may be for example a filter dye. If the colloid layer is an under layer the additive may be for example, a bleachable anti-halation dye. If the colloid layer is the backing layer the additive may be for example an anti-halation dye.

Suitable water-soluble organic compounds of use in preparing the photographic additive granules used in the process of the present invention belong to the following classes of compounds:

(a) derivatives, particularly alkyl derivatives, of urea and thiourea, preferably those of the formula

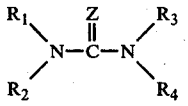

wherein $R_1$, $R_2$, $R_3$ and $R_4$ each independently represent alkyl having 1–4 carbon atoms, optionally substituted by hydroxyl, cycloalkyl or phenyl; tolyl, which is optionally substituted with OH- groups; and wherein $R_1$, $R_2$ and $R_3$ can also be hydrogen; and Z represents oxygen or sulphur. The following examples may be given: N-ethylurea, N-butylurea; N-(3-tolyl)-urea, N,N'-dimethylurea, N,N'-bis-(hydroxy-methyl)-urea, N,N'-ethyleneurea, N-methylthiourea, N,N'-dimethylthiourea, N-ethyl-N-phenylurea and N-hydroxymethylurea.

(b) saturated and unsaturated mono- and dicarboxylic acid amides, particularly those of formula $$R—CO—NH_2 \text{ or } R—(CONH_2)_2$$

wherein R represents an alkyl or alkylene radical having 1–6 carbon atoms, or the group —CH=CH—, $CH_2$=CH— or $CH_3CH$=CH—, also phenyl or tolyl, also heterocyclic saturated and/or unsaturated 5- or 6-membered ring having at least one N, O, S, CO or NH in the ring, whereby the symbol R can optionally be substituted also by OH, $NH_2$, halogen or hydroxyalkyl having 1–3 carbon atoms. These acid amides are, for example, acetamide, chloroacetamide, nicotinic acid amide and benzamide.

(c) lactams such as d-valerolactam, ε-valerolactam and oenantholactam;

(d) acid imides or derivatives of acid imides, especially those of the general formula

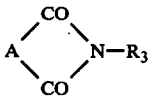

wherein A represents —CH=CH— or $—(CH_2)_n—$, wherein n is 1–6, and A can optionally be substituted by OH, $NH_2$ halogen, hydroxyalkyl ($C_1$–$C_3$) groups, and $R_3$ represents H, OH or hydroxyalkyl ($C_1$–$C_3$), examples of these are: succinimide, maleinimide and N-hydroxysuccinimide;

(e) oximes such as acetoneoxime, cyclohexanoneoxime and diacetylmonoxime;

(f) saturated and unsaturated 5- or 6- membered heterocyclic compounds which contain in the ring O, S, CO and NH, and which can optionally be substituted with OH, $NH_2$, halogen, alkyl ($C_1$–$C_4$), phenyl, hydroxyalkyl ($C_1$–$C_3$) - groups, such as symmetrical trioxane, imidazole, 2-methylimidazole, pyrazole, pyrazine, 2,3-dimethyl-1-phenyl-5-pyrazolone, and 1,2,4-triazole;

(g) aliphatic or aromatic, at least bivalent alcohols, such as 2,2-dimethyl- and 2,2-diethylpropanediol-1,3; dihydroxyacetone, o-xylylene glycol, erythrite, D-fructose, maltose, lactose, xylite, sorbitol and mannitol;

(h) polyalkylene glycols, such as polyethylene glycol preferably having a molecular weight of 1,000 to 20,000, especially those of the formula

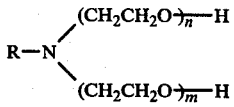

wherein R represents a saturated or unsaturated alkyl radical having 9 to 30 carbon atoms, and n and m each represents the numbers 3 to 200;

(i) carbamic acid esters, such as carbamic acid methyl ester, carbamic acid ethyl ester, and carbamic acid propyl ester.

(j) derivatives of benzene, particularly those of the general formula

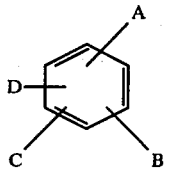

wherein A, B, C and D each independently represent OH, halogen, alkyl, hydroxyalkyl and alkoxy having 1 to 3 carbon atoms; and wherein A, B and C can be hydrogen; the following may for example be mentioned: 1,4-dihydroxybenzene, 2,6-dihydroxytoluene, 2,3-dihydroxytoluene, 2,4-dimethyl-1,5-dihydroxybenzene, 4,5-dimethyl-1,2-dihydroxybenzene, 3,5-dimethyl-1,2-dihydroxybenzene, 1,2-bis-(hydroxymethyl)-benzene, 1,3-bis(hydroxymethyl)-benzene), 1,4-bis-(hydroxymethyl)benzene, 2-chloro-1,4-dihydroxybenzene, 4-chloro-1,2-dihydroxybenzene, 1-chloro-2,4-dihydroxybenzene, 1-chloro-3,5-dihydroxybenzene, 1-chloro-2,5-dimethyl-4-hydroxybenzene and 1-chloro-4,5-dimethyl-2-hydroxybenzene.

The most preferred classes of compounds for use in the present invention are the aliphatic at-least-bivalent-alcohols of (g).

Two compounds of especial use are lactose and sorbitol. Both of these compounds can be considered as very water-soluble, sorbitol having a water solubility of 830g/liter at 20° C. and lactose 170g/liter at 20° C.

Suitable inorganic salts are water-insoluble colourless salts which produce a neutral pH solution when dissolved for example salts of the alkaline metals or ammonium for example sodium chloride, potassium sulphate and ammonium nitrate.

As stated preferably there is present in the photographic additive granule used in the present invention a solid wetting-agent which may be of an anionic and/or non-ionic nature. The presence of the wetting agent tends to improve the dispersibility of the optical sensitizing dye or other photographic additive in the aqueous colloid coating composition.

The non-ionic wetting agents of use are, in particular polyglycol ethers such as alkyl-polyglycol ether or alkylphenylpolyglycol ether, for example, octylphhenylpolyglycol ether and fatty acid polyglycol esters. Suitable anionic wetting agents are, e.g. the most varied sulphates, for example, sulphated primary aliphatic alcohols having 10 to 18 carbon atoms, such as sodium decyl sulphate, sodium lauryl sulphate, sodium myristyl sulphate and sodium oleyl sulphate or sulphated secondary aliphatic alcohols; also sulphated unsaturated fatty acids, fatty acid polyglycol ethers or sulphated fatty acid amides, sulphated alkyleneoxy adducts, sulphated partially esterified polyvalent alcohols; and, in particular, the sulphonates such as alkylsulphonates, for example, laurylsulphonate, cetylsulphonate, stearylsulphonate, petroleum sulphonates, naphthenesulphonates, olefinsulphonates, mersolates, sodium dialkylsulphosuccinates such as sodium dioctylsulphosuccinate and taurides, for example, oleyl methyl tauride (sodium salt), alkylarylsulphonates such as alkylbenzenesulphonates having a straight-chain or branched alkyl chain containing about 7 to 20 carbon atoms and mono- and dialkylnaphthalenesulphonates such as nonylbenzenesulphonate, dodecylbenzene-sulphonate and hexadecylbenzenesulphonate, as well as 1-isopropylnaphthalene-2-sulphonate, di-isopropylnaphthalenesulphonate, di-n-butylnaphthalenesulphonate, di-iso-butylnaphthalenesulphonate; condensation products from naphthalenesulphonic acid and formaldehyde, such as dinaphthylmethanedisulphonate, also lignin sulphonates and oxylignin sulphonates, sulphonates of polycarboxylic acid esters and polycarboxylic acid amides, and condensation products of fatty acids with aminoalkylsulphonates, also phosphated surfactants such as mono- and diphosphate esters of oxethylated fatty alcohols, alkylphenols and fatty acids.

The process of the present invention is of particular use in dispersing optical sensitizing dyes in photographic emulsions and therefore according to an especially preferred aspect of the present invention there is provided a process for the preparation of photographic material which comprises the steps of forming photographic additive granules from a homogeneous mixture of a finely-divided water-soluble photographically inert solid and at least one optical sensitizing dye, the optical sensitizing dye or dyes constituting from 5 to 50% by weight of the granule, a finely divided inert solid which constitutes from 35 to 85% by weight, a finely divided wetting agent which comprises from 1 to 15% by weight and from 1 to 10% by weight of a hydrophilic colloid, each granule having the same composition, adding the requisite weight of granules so formed to an aqueous silver halide emulsion, allowing the granules to dissolve and coating the emulsion as a layer on photographic base and drying the composition.

This process is applicable to optical or spectral sensitising dyes which are soluble in water as well as those which are substantially insoluble in aqueous solution. Substantially insoluble refers to sensitising dyes which have a solubility in water(at 20° C.) of less than 0.1 percent by weight. Among the useful optical sensitising dyes are the cyanine dyes, the hemicyanine or merocyanine dyes and the styryl dyes and oxonol dyes and other dyes containing the amidinium ion auxo-chromophore system, such as rhodamine, pinacyanol and pinaflavol. When substantially water-insoluble optical sensitising dyes are added to an aqueous silver halide emulsion in the form of granules the granules slowly break-down and dissolve causing the optical sensitising dye to disperse in such a form that it absorbs on to the silver halide crystals, dyeing the silver halide uniformly and thus optically sensitising it.

As hereinbefore stated the process of this invention can also be used for other dyes, colourants, antifoggants, stabilisers, colour couplers, hardeners, optical brighteners and coating aids which are difficulty soluble in conventional solvents, and to other photographic additives which despite being soluble in conventional solvents are desired to be formed into higher concentration solutions than is possible using conventional solvent.

The photographic layer prepared in the process of the present invention is usually a photosensitive silver halide layer but it may be for example a supercoat or protective layer, an inter-layer and in particular a filter layer, an undercoat layer or a backing layer. If the layer prepared is a silver halide layer this layer may comprise any silver halide composition for example silver chloride, silver bromide, silver iodide and mixed halide such as chlorobromide and iodobromide. The silver halide layers may of course contain other additives for example chemical sensitisers such as noble metals, sulphur compounds and polyalkylene oxides, coating aids and sequestering agents.

The photographic material produced by the process of the present invention may be any photographic material for example black and white camera film and graphic arts films, black and white paper, colour films and paper and X-ray films.

The following Examples will serve to illustrate the invention but do not limit the scope thereof.

EXAMPLE I

A gold sensitised silver iodo-bromide gelatino emulsion containing 8.8 mole % of silver iodide was stabilised with an aqueous solution of 4-hydroxy-6-methyl-1,3,3*a*,7-tetrazaindene and divided into two portions. Each portion of emulsion was spectrally sensitised, using the mixture of sensitisers of the formula (101), (102) and (103) in the ratio 6 parts (101) to 3 parts (102) to 1 part (103) (by weight).

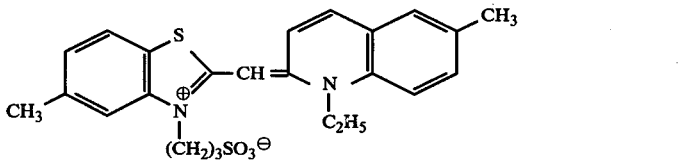

(101)

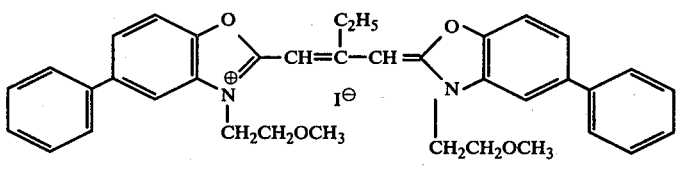

(102)

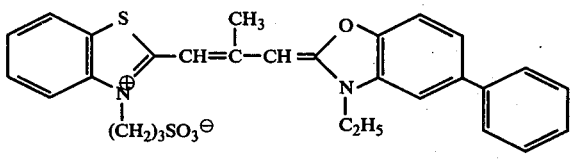

(103)

In sample (a) 20 mg of the mixture of the sensitizers was ground together with 340 mg of sorbitol and 40 mg of sodium lauryl sulphate in a ball mill. The ground mixture was then mixed with 40 mg 10% gelatin solution. The resulting paste was noodled by passing through a sieve with 1 mm diam. holes. The noodles were dried in warm air. The noodles were added to 100 g of the above mentioned emulsion and the emulsion stirred at 40° C. for 15 minutes to prepare Sample (a).

(b) To 20 mg of the mixture of the sensitizers was added ethanol to form a dye solution. The amount of ethanol required to completely dissolve the dye was 39 ml. This solution was added to 100 g of the second portion of the above mentioned emulsion to prepare a control sample (b). To each emulsion portion was added a phenolic cyan dye forming coupler dispersed in a high boiling solvent.

The coupler used was 2-{4-[2,4-Bis(1,1-dimethylpropyl) phenoxy]butylcarbamoyl}-1-naphthol in tritolyl phosphate at a ratio of coupler to oil of 1:1. The coupler was added to the emulsion at the rate of 1g of coupler per 2 g of silver.

The emulsion portions were then coated on a support base. These photographic coatings were exposed for 1/30th second through an ILFORD 204 filter and processed by a colour negative process which comprises a developing solution, a bleaching solution, a fixing solution and a stabilising solution.

The process used is as follows:

Developer

| Constituents | Fresh Tank Solution Formulation |
|---|---|
| Water at 21° C to 27° C | 800 ml |
| Potassium Carbonate (Anhydrous) | 37.5 g |
| Sodium Sulphite (Anhydrous) | 4.25 g |
| Potassium Iodide | 2.0 mg |
| Sodium Bromide | 1.3 g |
| Hydroxylamine Sulphate | 2.0 g |
| Sodium hexametaphosphate | 2.5 g |
| 4-amino-3-methyl-N-ethyl-N-hydroxyethyl anilino-hydrogen sulfate | 4.75 g |
| Water to make | 1 liter |
| pH at 27° C | 10.00 ± 0.03 |

Bleach

| Constituents | Fresh Tank Solution Formulation |
|---|---|
| Water at 21° C to 27 ° C | 600 ml |
| Ammonium Bromide | 150 g |
| Ferric Ammonium E.D.T.A. (1.56 molar) | 175 ml |
| Acetic Acid (GLACIAL) | 10.5 ml |
| Sodium Nitrate | 35 g |
| Water to make | 1 liter |
| pH at 27° C | 6.00 ± 0.20 |

Fixer

| Constituents | Fresh Working Solution Formulation |
|---|---|
| Water at 21° C to 27° C | 800 ml |
| Ammonium Thiosulphate (50% soln.) | 162 ml |
| Ethylenedinitrilo Tetraacetic Acid Disodium Salt | 1.25 g |
| Sodium Bisulphite (Anhydrous) | 12.4 g |
| Sodium Hydroxide | 2.4 g |
| Water to make | 1 liter |
| pH at 27° C | 6.50 ± 0.20 |

Stabiliser

| Constituents | Fresh Working Solution Formulation |
|---|---|
| Water at 21° C to 27° C | 800 ml |
| Formalin (37% solution) | 5.0 ml |
| Wetting agent | 0.8 ml |

-continued

| Stabiliser Constituents | Fresh Working Solution Formulation |
|---|---|
| Water to make | 1 liter |

The process is carried out as follows:

| Solution/Procedure | | Remarks | Temp. ° C | Time in Mins |
|---|---|---|---|---|
| 1 | Developer | Total Darkness | 37.8 ± 0.2 | 3¼ |
| 2 | Bleach | Total Darkness | 37.8 ± 3 | 6½ |
| 3 | Wash | Room Lighting | 37.8 ± 3 | 3¼ |
| 4 | Fixer | Room Lighting | 24 – 41 | 6½ |
| 5 | Wash | Room Lighting | 37.8 ± 3 | 3¼ |
| 6 | Stabiliser | Room Lighting | 24 – 41 | 1½ |
| 7 | Dry | Room Lighting | 24 – 41 | 10 –20 |

The results were as shown in the table.

TABLE

| | Sample | Speed | Fog | Sens Max |
|---|---|---|---|---|
| a) | Present Process | 100 | .18 | 530 & 550 |
| b) | Conventional Process | 100 | .18 | 530 & 500 |

As can be seen from the Table no difference exists in photographic properties between the present invention and the conventional process. However the method of the invention gave better coating quality because the presence of alcohol causes local dehydration which results in particulate matter, which is difficult to re-disperse. This particulate matter remains in the composition causing coating defects such as streaks and spots. Such streaks were observed in sample (b) but none in sample (a).

EXAMPLE II

This example serves to show the use of the present invention for introducing additives other than optical sensitizing dyes with photographic material. The additive used is a photographic silver halide emulsion stabilizer 4-hydroxy-6-methyl-1,3,3*a*,7-tetraazaindene.

Often it is desired that concentrated aqueous solutions of photographic additives are prepared in bulk and stored and then added to the silver halide emulsion whilst the emulsion is being prepared. However solutions of 4-hydroxy-6-methyl-1,3,3*a*,7-tetraazaindene greater in strength than 1% weight per volume in water are unsuitable and precipitate if stored for more than three days. It is preferred to add a more concentrated aqueous solution than a 1% solution of this additive to the silver halide emulsion during preparation.

Granules containing the additive were prepared as follows:

5 g of the additive was ground together with 10 g of sodium lauryl sulphate in ball mill. The ground mixture was blended with 85 g of lactose using a planetry mixer. The dry powder mixture was then mixed with 10 g of 10% aqueous gelatin solution and the resulting wet mass was granulated by passing through a sieve with 2 mm mesh. The granules were dried in warm air and then passed through a 1 mm mesh sieve. The granules contained 5% additive.

The granules could be stored without any apparent deterioration of the stabiliser.

When added to an aqueous silver halide gelatino emulsion the granules dissolved rapidly. After the emulsion had been coated and dried it was conventionally exposed and processed. The silver halide emulsion was found to be correctly stabilized as there was no overdigestion of the emulsion apparent.

What we claim is:

1. In a method for preparing photographic material which comprises at least one silver halide emulsion layer coated on the photobase the steps of adding to an aqueous photographic colloid coating composition a solid photographic additive composition in granular form which comprises a homogeneous mixture of 5 to 50% by weight of at least one finely-divided photographic additive, 35 to 85% by weight of at least one finely-divided water-soluble solid organic compound which acts as a dispersing agent for the additive and which is a derivative of urea or thiourea, a saturated or unsaturated mono-or dicarboxylic acid amide, a lactam, an acid imide or derivative thereof, an oxime, a saturated or unsaturated 5- or 6-membered heterocyclic compound which contains in the ring O, S, CO and NH, and which can optionally be substituted with OH, $NH_2$, halogen, alkyl ($C_1$–$C_4$), phenyl or hydroxyalkyl ($C_1$–$C_3$) - groups, an aliphatic or aromatic, at least bivalent alcohol, a polyalkylene glycol, a carbamic acid ester, or a derivative of benzene, 1 to 15% by weight of a solid wetting agent and 1 to 10% by weight of a solid photographically inert hydrophilic colloid which acts as a binder for the granule, allowing the granular composition to dissolve, coating the aqueous photographic colloid coating composition as a layer on a photobase and drying.

2. A method according to claim 1 wherein the photographically inert hydrophilic colloid used as the binder in the granules is gelatin, sodium cellulose sulphate, carboxy methyl cellulose, albumen, casein, polyvinyl alcohol or polyvinyl pyrrolidone.

3. A method according to claim 2 wherein the inert hydrophilic colloid is gelatin.

4. A method according to claim 1 which comprises the steps of making a homogeneous mixture of a finely divided water-soluble photographically inert solid, at least one finely divided water-insoluble photographic additive, a finely divided solid wetting agent, a finely divided hydrophilic colloid and water, forming a paste of the mixture, noodling the paste and drying the noodles to form granules, each granule being substantially of the same constitution and containing from 5 to 50% by weight of the photographic additive or additives, from 35 to 85% by weight of the water-soluble solid, from 1 to 15% by weight of the solid wetting agent and from 1 to 10% by weight of the hydrophilic colloid, then adding the requisite weight of the granules to an aqueous photographic colloid coating composition allowing the granules to dissolve and coating the aqueous coating composition as a layer on photographic base and drying.

5. A method according to claim 4 wherein the paste is noodled by passing it through a sieve.

6. A method according to claim 1 wherein the layer prepared in the photographic material is a silver halide emulsion layer.

7. A method according to claim 6 wherein the photographic additive is a stabilizer, anti-foggant, colour coupler, acutance dye, hardener, optical brightening agent, coating aid or optical sensitising dye.

8. A method according to claim 7 wherein the photographic additive is an optical sensitising dye which comprises the steps of forming a homogeneous mixture of a finely-divided water-soluble photographically inert solid and at least one optical sensitizing dye, the optical sensitizing dye or dyes constituting from 5 to 50% by weight of the granule, a finely divided inert solid which constitutes from 35 to 85% by weight, a finely divided wetting agent which comprises from 1 to 15% by weight and from 1 to 10% by weight of a hydrophilic colloid, each granule having the same composition, adding the requisite weight of granules so formed to an aqueous silver halide emulsion, allowing the granules to dissolve and coating the emulsion as a layer on photographic base and drying the composition.

9. A method according to claim 1 wherein the layer prepared in the photographic material is a non-light sensitive colloid layer.

10. A method according to claim 9 wherein the non-light sensitive colloid layer is a gelatin layer which is present in the photographic material as an inter-layer between silver halide emulsion layers as a super coat layer, as an under-layer or as a backing layer.

11. A method according to claim 1 wherein the finely divided water-soluble photographically inert solid is a salt of an alkaline metal or ammonium.

12. A method according to claim 1 wherein the aliphatic or aromatic at least bivalent alcohol is 2,2-dimethyl- and 2,2-diethylpropanediol-1,3,dihydroxyacetone, o-xylylene glycol, erythrite, D-fructose, maltose, lactose, xylite, sorbitol or mannitol.

13. A method according to claim 12 wherein the at least bivalent alcohol is lactose or sorbitol.

14. A method according to claim 1 wherein the wetting agent is a non-ionic surfactant.

15. A method according to claim 14, wherein the non-ionic surfactants are alkyl-polyglycol ethers, alkylphenyl-polyglycol-ethers or fatty acid polyglycol esters.

16. A method according to claim 1 wherein the wetting agent is an anionic surfactant.

17. A method according to claim 16 wherein the anionic surfactants are sulphated primary or secondary aliphatic alcohols having 10 to 18 carbon atoms, sulphated unsaturated fatty acids, fatty acid polyglycol esters or sulphated fatty acid amides, sulphated alkyleneoxy adducts, sulphated partially esterified polyvalent alcohols, alkylsulphonates, naphthenesulphonates, olefinsulphonates, mersolates, sodium dialkylsulphosuccinates, taurides, alkylarylsulphonates, mono- and dialkylnaphthalenesulphonates, condensation products from naphthalenesulphonic acid and formaldehyde, lignin sulphonates and oxylignin sulphonates, sulphonates of polycarboxylic acid esters and polycarboxylic acid amides, condensation products of fatty acids with aminoalkylsulphonates, and phosphated surfactants.

18. Photographic material which has been prepared by the method claimed in claim 1.

* * * * *